United States Patent [19]

Jordan

[11] Patent Number: 4,572,364

[45] Date of Patent: Feb. 25, 1986

[54] CLOTHES DRYING GARMENT BAG

[76] Inventor: William T. Jordan, 42932 Via Valparaiso, Fremont, Calif. 94538

[21] Appl. No.: 632,028

[22] Filed: Jul. 18, 1984

[51] Int. Cl.[4] ..... B65D 85/18; F26B 13/00

[52] U.S. Cl. ..... 206/287; 34/151; 34/232

[58] Field of Search ..... 206/286, 287, 289, 284, 206/278, 287.1, 288; 34/151, 163, 201, 233, 219, 232

[56] References Cited

U.S. PATENT DOCUMENTS

| | | | |
|---|---|---|---|
| 2,154,630 | 4/1939 | Marbury et al. | 206/287.1 |
| 2,502,033 | 3/1950 | Bohn | 206/287.1 |
| 2,975,529 | 3/1961 | Weber | 206/287 X |
| 3,007,567 | 11/1961 | Rosen | 206/287 |
| 3,095,125 | 6/1963 | Bundy . | |
| 3,264,755 | 8/1966 | Moore | 206/287 X |
| 3,298,113 | 1/1967 | Friedman | 34/219 |
| 3,432,939 | 3/1969 | Eichholz . | |
| 3,487,557 | 1/1970 | Linstead | 34/151 |
| 3,739,492 | 6/1973 | Brooks . | |
| 3,831,740 | 8/1974 | Pendergast | 206/287 X |
| 3,905,125 | 9/1975 | Hubner | 34/151 |
| 4,189,036 | 2/1980 | Pelavin | 206/278 |
| 4,406,071 | 9/1983 | Buchanan . | |

FOREIGN PATENT DOCUMENTS

| | | | |
|---|---|---|---|
| 472405 | 3/1951 | Canada | 206/286 |
| 450268 | 4/1968 | Switzerland | 206/284 |

*Primary Examiner*—Allan N. Shoap
*Assistant Examiner*—Bryon Gehman
*Attorney, Agent, or Firm*—Manfred M. Warren; Robert B. Chickering; Glen R. Grunewald

[57] ABSTRACT

A garment bag that can also be used as a portable clothes dryer, having a flexible, foldable enclosure with a top gusset adapted to admit the neck of a portable blower-type hair dryer, long side panels and a closed bottom. Also included is a closable opening in one side panel, a plurality of vents near the top and at least one vent at the bottom and a flexible carrying handle attached at spaced locations in the top of the bag.

6 Claims, 1 Drawing Figure

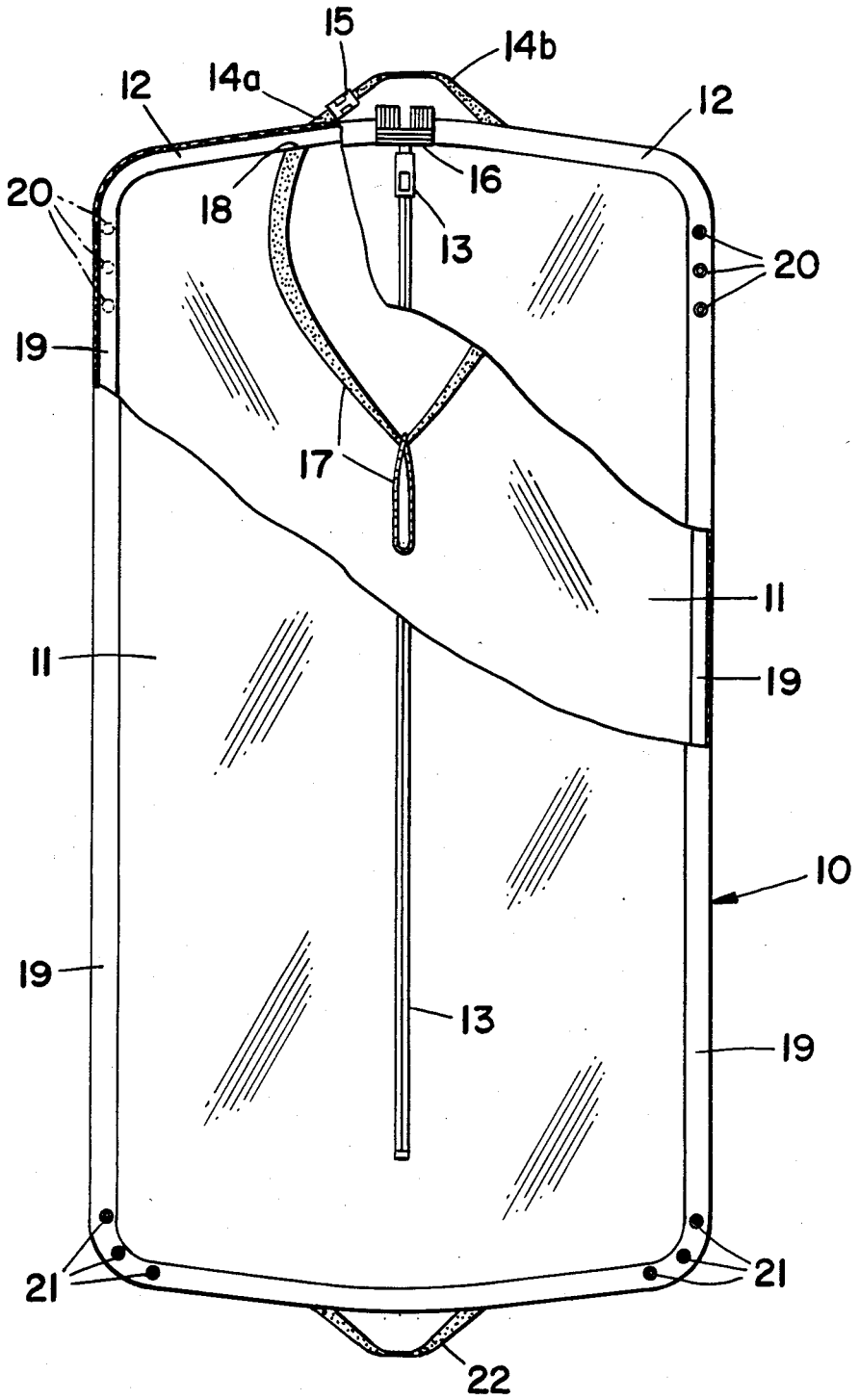
15
14b
12
14a
12
16
20
18
13
20
19
17
11
11
19
10
19
13
19
21
21
22

CLOTHES DRYING GARMENT BAG

BACKGROUND OF THE INVENTION

1. Field of the Invention

This invention relates to a garment bag adaptable for use as a portable clothes dryer.

2. Description of the Prior Art

Much of the prior art in this field has concentrated on providing portable garment drying appliances with built-in heating devices or blowers. Illustrative relevant patents are U.S. Pat. Nos. 3,432,939; 3,095,125; and 3,739,492. These devices typically reduce to a package that can be carried on a trip. They consist either of a hinged container or frame, as in U.S. Pat. No. 3,095,125, or an expandable box, as in U.S. Pat. No. 3,432,939. An improvement over the foregoing devices is disclosed in U.S. Pat. No. 3,739,492, in which a blower is incorporated into the structure of a bag to inflate the bag in use, thereby eliminating the bulky, rigid containers of those devices. Other patents disclose the use of portable hair dryers to dry clothes in devices with special brackets to hold the hair dryers. For example see U.S. Pat. No. 4,406,071.

SUMMARY OF THE INVENTION

Although all of these devices can be used successfully by travelers, they are somewhat inconvenient because they must be carried as separate items to ba packed in addition to the items that a traveler normally carries. This invention is a clothing dryer that makes use of items a traveler carries for other purposes and eliminates the need for carrying and storing an additional device which is heavy and consumes valuable luggage space.

The device of this invention makes use of two commonly carried items that travelers use, a garment bag and a portable blow-type hair dryer. The garment bag is constructed to enable it to be used as a clothes dryer in conjunction with an ordinary blow-type hair dryer.

It is therefore an object of the present invention to provide a garment bag that also can be used as a portable clothes dryer when used with a portable blow-type hair dryer.

Another object of the present invention is to provide a garment bag having an opening to receive the air discharge portion of a portable blower-type hair dryer. This opening is positioned and constructed to hold the hair dryer stably without the use of a rigid frame.

Another object of the present invention is to provide a garment bag which, when used with a portable hair dryer, will produce a hot air flow pattern within the bag to dry clothing quickly, uniformly and wrinkle-free.

Other objects, advantages and features will become apparent from the subsequent detailed description and drawings. The garment bag of this invention includes a flexible, foldable enclosure, having a top gusset adapted to admit the neck of a blower, long side panels, and a closed bottom. The device also includes a closable opening in one of the side panels for the purpose of inserting and removing garments. Opposite ends of a flexible carrying handle are attached at spaced locations to the top of the bag, and a hanging means, is located inside the bag for suspending clothes hangers. Preferably the carrying handle extends into the bag to form the hanging means and the handle itself includes a buckle or equivalent means for opening the handle so that the bag may be hung on a support such as the bar supporting a shower curtain.

The top gusset of this device has an elasticized opening in its central portion, between the attachments of the opposite ends of the carrying handle. The opening is expandable to receive the air discharge portion of a portable blower-type hair dryer snuggly. In the preferred embodiment the ends of the handle are sewed into one of the seams between the top gusset and a side panel and the elasticized opening is positioned between the attachments. The opening occupies a central position in the gusset while the handle attachment is offset, as later described, whereby the blower is maintained vertically when in use.

The device is also provided with a plurality of vents near the top and at least one vent at the bottom of the bag, to permit venting of air and drainage of water from the bag.

The use of the device of the present invention will be described with reference to washing a shirt in a hotel room which is a frequent use of device of this character. The shirt is washed in a washbasin and, after a light wringing to allow excess water to drain, is placed on a garment hanger which is then hung on the handing means within the bag, which has been emptied in anticipation of its use as a dryer.

The bag is hung o the bar supporting a shower curtain, the zipper is closed, and the air discharge portion of a blower-type dryer is inserted into the elasticized opening in the top gusset of the bag. The hair dryer is turned on with the desired degree of heat, and a stream of hot air blows past the shirt to the bag bottom, inflating the bag and causing it to balloon out in all directions. Because vents are located in the top and in the bottom portions of the bag turbulent air flow is created. Air from the blower passes to the bottom of the bag as a compact stream and then flows toward the top of the bag turbulently to be vented from the upper vents. The upper vents are located higher than the hanging means whereby a garment will not be drawn into them to prevent the air from circulating and venting. It has been found that use of both top vents and bottom vents causes a 20% improvement in drying time as compared to the use of bottom vents alone. Turbulence within the bag cause the shirt to be subjected to a tumbling action which dries it with a minimum of wrinkles in about 10 to 15 minutes. Of course the weight of the fabric from which the shirt is made and the temperature and volume of hot air will influence the time of drying.

BRIEF DESCRIPTION OF THE DRAWING

The FIGURE is an elevational view of the device, illustrated partially cut away.

DETAILED DESCRIPTION OF THE INVENTION

Referring to the FIGURE there is illustrated the garment bag of the present invention, generally designated 10, consisting of two side panels 11 and top gusset 12, both of which are made of fabric that is suitable for use in luggage, relatively impermeable to the passage of air and insensitive to moderate heat. One of side panels 11 is provided with zippered opening 13 to permit the insertion and removal of garments.

Attached at spaced locations in the top of bag 10, is flexible carrying handle 14, comprising portions **14*a* and 14*b* and detachment means 15. Between the areas of attachment of carrying handle 14 is centrally located elasticized opening 16, formed to permit the reception of the air discharge portion of a portable blower-type hair dryer. Because elasticized opening 16 is expandable, a variety of different size blowers are useable with this device. Additionally, opening 16 helps to form a relatively tight connection between the blower and the bag, and its central location on the center of gravity of bag 10** causes the blower to hang vertically.

Further provided is hanging means 17 within bag 10 to suspend a hanger for clothing. In the embodiment illustrated, hanging means 17 comprises an extension of carrying handle 14, which is sewn into seam 18 between gusset 12 and one of panels 11. In this manner, the weight of the clothes to be dried is supported by handle 14 rather than bag 10, and the amount of pressure required to inflate the bag is accordingly less than that required if a separate hanging means was provided.

For convenience in carrying, bag 10 is provided with second handle 22, enabling the traveller to carry bag 10 folded in half. When in use as luggage the bag 10 may have the tops of garment hangers protruding through opening 16 or the hangers may be otherwise held together so that garments will not slump when carried. The device may also have normally horizontal interior straps, as known to the art, to adapt it for use as luggage by holding garments to be carried when folded.

Also illustrated are side gussets 19, attached between side panels 11, and provided with three upper vents 20 on each side and lower vents 21 on each side one of which is in the bottom of the bag to provide drainage of liquid water. Upper vents 20 are located above the position of a hanger to prevent the venting of air from drawing part of a garment into the vents thereby blocking the vents. For the same reason, bottom vents 21 are located in side gussets 19 below the position of a long garment.

To use the device of the present invention, zippered opening 13 is opened, an article of wet clothing is placed on a hanger within bag 10 and hung from hanging means 17. Opening 13 is then closed and the bag is suspended from a closet rod or shower curtain rod by releasing detachment means 15, positioning portions 14*a* and 14*b* of carrying handle 14 about the rod and reattaching detachment means 15. The air discharge portion of a portable blower-type dryer is inserted into elasticized opening 16 in top gusset 12 and the blower is plugged into an electric wall socket and turned on. The portable blower is preferably positioned with its handle extending through the loop formed by handle 14 to balance the off-center position of attachment of handle 14 to the gusset seam.

The downwardly flowing stream of hot air from the blower cuases bag 10 to inflate. Vents 20 and 21 permit the venting of excess hot air and foster air circulation throughout the bag, causing a tumbling effect that permits the garment inside to dry wrinkle free. Additionally, vents 21, allow the escape of water that may drip from the garment while drying. When the bag is inflated top gusset 12 and portions of panels 11 form a relatively flat, horizontal surface that holds the hair dryer firmly in hole 16.

When the garment has dried, opening 13 is unzipped, the garment and dryer are removed and bag 10 can be taken down from the shower or closet rod and used again as an ordinary garment bag.

What is claimed is:

1. A garment bag suitable for use as a portable clothes dryer comprising:

a. two side panels made of flexible, foldable material, one of said side panels having an opening for the insertion of garments, b. a top gusset connected between the top portions of said side panels, said top gusset being made of flexible, foldable material, c. a top flexible handle attached at spaced locations in the top of said garment bag, d. an elasticized opening in the central portion of said top gusset and between the areas of attachment of said top carrying handle, said elasticized opening having an expandable opening size to receive the air discharge portion of a portable blower-type hair dryer, e. hanging means within said bag to suspend a hanger for clothing, f. a plurality of upper vents in said bag located above the lower portion of said hanging means, and g. a bottom vent in said bag, positioned to drain water from the bottom of said bag, whereby air introduced into said elasticized opening from a hair dryer flows downwardly as a compact stream, reverses direction and flows upwardly as a turbulent stream inflating said bag and exiting through said upper vents.

2. The garment bag as described in claim 1 wherein, said top handle is sewn into the seam formed by said top gusset and one of said side panels.

3. The garment bag as described in claim 1 wherein, said top handle extends into said bag to form said hanging means.

4. The garment bag as described in claim 1 wherein, said top handle includes detachment means.

5. The garment bag as described in claim 1 wherein, said bag includes sides gussets connected between the side portions of said side panels, said side gussets being made of flexible, foldable material.

6. The garment bag as described in claim 5 wherein, said upper vents are located in said side gussets above the lower portion of said hanging means.

* * * * *